US009155173B2

(12) United States Patent
Kumar

(10) Patent No.: US 9,155,173 B2
(45) Date of Patent: Oct. 6, 2015

(54) DUAL-MODE DIMMABLE RECEPTACLE

(71) Applicant: Russikesh Kumar, Ridgewood, NJ (US)

(72) Inventor: Russikesh Kumar, Ridgewood, NJ (US)

(73) Assignee: Creston Electronics, Inc., Rockleigh, NJ (US)

( * ) Notice: Subject to any disclaimer, the term of this patent is extended or adjusted under 35 U.S.C. 154(b) by 587 days.

(21) Appl. No.: 13/632,315

(22) Filed: Oct. 1, 2012

(65) Prior Publication Data

US 2014/0091730 A1 Apr. 3, 2014

(51) Int. Cl.
*H05B 37/02* (2006.01)
*H01R 25/00* (2006.01)

(52) U.S. Cl.
CPC ..... *H05B 37/0272* (2013.01); *H01R 25/006* (2013.01)

(58) Field of Classification Search
USPC ..... 315/291, 297, 299–300, 302, 306, 307, 315/313; 439/620.15, 620.21, 646, 949
See application file for complete search history.

(56) References Cited

U.S. PATENT DOCUMENTS

| | | | | |
|---|---|---|---|---|
| 3,898,516 | A * | 8/1975 | Nakasone | 315/194 |
| 5,453,899 | A * | 9/1995 | Page | 361/1 |
| 5,621,256 | A * | 4/1997 | Crane et al. | 307/125 |
| 7,198,523 | B2 | 4/2007 | Adams | |
| 7,311,558 | B2 | 12/2007 | Adams | |
| 2008/0218148 | A1 * | 9/2008 | Robertson et al. | 323/349 |

* cited by examiner

*Primary Examiner* — Douglas W Owens
*Assistant Examiner* — James H Cho
(74) *Attorney, Agent, or Firm* — Creston Electronics, Inc.

(57) ABSTRACT

An electric receptacle capable of operating in a dimmable mode and a standard mode comprises an opening for receipt of an adapter. The adapter is received by the electric receptacle and switches the electric receptacle from the standard mode to the dimmable mode. The adapter is dimensioned to fit over a standard plug and the electric receptacle is configured to receive a standard plug.

28 Claims, 7 Drawing Sheets

DUAL-MODE DIMMABLE RECEPTACLE

BACKGROUND OF THE INVENTION

1. Technical Field

The present invention relates to lighting control systems.

2. Background Art

Lighting control systems allow users to control the level of lighting in one or more areas of a structure. Lamps in the system may be switched off, switched on or dimmed to an intermediate light level. Typically, dimmers for lighting loads are incorporated into the same unit as an on/off switch or are wired as an intermediate device between the lighting load and the switch. Often, however, table and floor lamps plugged into an electric receptacle need to be dimmed as part of a lighting control system. Current solutions to dim these devices are inadequate.

One solution is to install a standard dimmer wired to the receptacle for powering the table or floor lamp. However, control of a standard receptacle by a lighting dimmer may have undesirable results. Therefore, to meet National Electrical Code (NEC) regulations, the receptacle must be replaced with a non-standard receptacle. In the United States, the standard electric receptacle used in residential applications is nominally capable of supplying fifteen (15) amps (A) at one hundred ten (110) volts (V), which is equivalent to 1.65 kilowatts (kW). A typical lighting dimmer is not designed to handle such power. If a power load connected to a dimmer were to draw more than the rated capacity for the dimmer, the dimmer could be damaged.

Moreover, restricted electrical voltage supplied to a motor load connected to a dimmer-controlled receptacle could lead to motor stalling. Some motors designed for a 100 V power supply, for example, may stall if the voltage drops below even 100 V. An electric motor that remains stalled for a long period of time with even a small amount of current flowing through it could overheat, potentially starting a fire.

Accordingly, to meet NEC regulations, the receptacle must be replaced with a non-standard receptacle. Accordingly, the lamp plug must be altered to match the non-uniform receptacle. This prevents other appliances with standard shaped plugs such as vacuum cleaners from being plugged into the dimmer controlled receptacle. However, this solution limits the utility of the electric receptacle as only loads with modified plugs may be powered by the receptacle.

Another common solution, a plug in dimmer module, plugs into an electric receptacle between the lamp plug and the electric receptacle. This intermediate device contains dimming circuitry to control the light level of the lamp. This method is simple from an installation perspective, but the modules can be bulky and unsightly.

A screw-in lamp base adapter is another solution. The base adapter contains dimming circuitry and screws into the lamp in place of the bulb. The bulb is then screwed into the base adapter. This is a simple solution to install as well, but it causes lamp shades to move out of position and can only be used on lamps that provide sufficient space for the plug adapter.

An alternate solution which meets NEC wiring regulations is not bulky or aesthetically unappealing and is straightforward from an installation and user perspective is desired.

SUMMARY OF THE INVENTION

It is to be understood that both the general and detailed descriptions that follow are exemplary and explanatory only and are not restrictive of the invention.

DISCLOSURE OF INVENTION

Principles of the invention provide systems, devices and methods for mounting electronics in a ceiling. For example, according to a first aspect, the present invention provides an electric receptacle configured for operating in a dimmable mode when a plug coupled to a plug adapter is inserted into the electric receptacle and operating in a standard mode when a plug not coupled to a plug adapter is inserted into the electric receptacle.

According to a second aspect, the present invention provides an electric receptacle system comprising a plug adapter and an electric receptacle. The plug adapter comprises an actuating portion and is configured for receiving a hot plug terminal of a plug and a neutral plug terminal of the plug. The electric receptacle comprises a bypass opening defined by the face of the electric receptacle and is configured for operating in a dimmable mode when the actuating portion of the plug adapter is inserted into the bypass opening and operating in a standard mode when the actuating portion of the plug adapter is inserted into the bypass opening.

According to a third aspect, the present invention provides a method for operating a dual-mode electric receptacle. The method comprises the steps of inserting a hot plug terminal of a plug and a neutral plug terminal of the plug into a plug adapter, the plug adapter comprising an actuating portion and a first adapter opening defined by a front surface of the plug adapter and aligned with and dimensioned for receiving the hot plug terminal and a second adapter opening defined by the front surface of the plug adapter and aligned with and dimensioned for receiving the neutral plug terminal; inserting the actuating portion, hot plug terminal and neutral plug terminal into the dual-mode electric receptacle, the electric receptacle comprising a first receptacle opening defined by a face of the electric receptacle and aligned with and dimensioned for receiving the hot plug terminal, a second receptacle opening defined by the face of the electric receptacle and aligned with and dimensioned for receiving the neutral plug terminal, and a bypass opening defined by the face of the electric receptacle and aligned with and dimensioned for receiving the actuating portion of the plug adapter; switching a bypass switch of the electric receptacle to an open state with the actuating portion of the plug adapter thereby placing the dual-mode electric receptacle in a dimmable mode; and operating the electric receptacle in the dimmable mode. The present invention seeks to overcome or at least ameliorate one or more of several problems, including but not limited to providing a dimmable receptacle that is aesthetically pleasing, easily installed and in accordance with NEC regulations.

BRIEF DESCRIPTION OF DRAWINGS

The accompanying figures further illustrate the present invention.

The components in the drawings are not necessarily drawn to scale, emphasis instead being placed upon clearly illustrating the principles of the present invention. In the drawings, like reference numerals designate corresponding parts throughout the several views.

BRIEF DESCRIPTION OF THE SEVERAL VIEWS OF THE DRAWING

Figure 1:
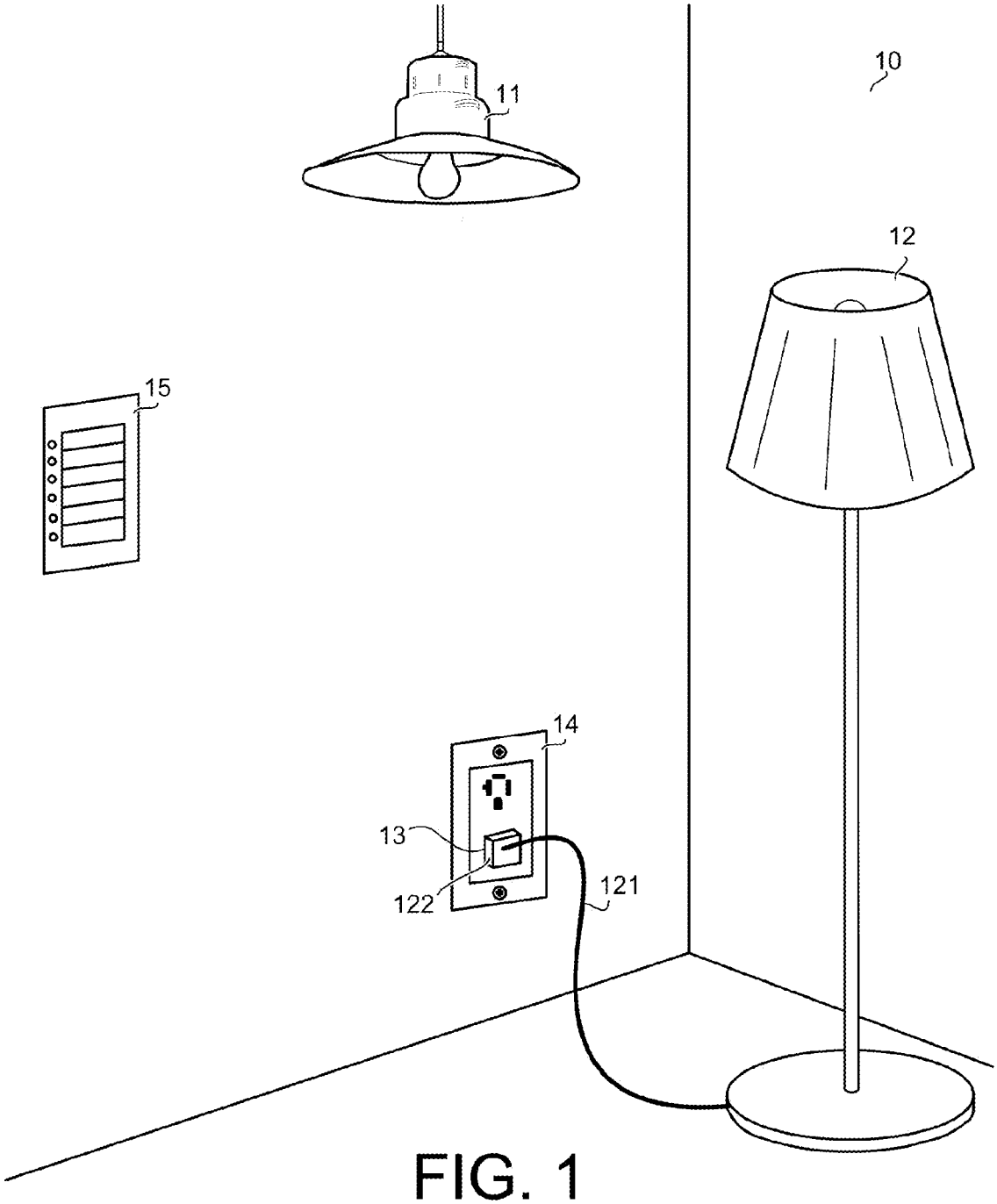

FIG. 1 shows a room controlled by a lighting control system, according to an illustrative embodiment of the invention.

Figure 2:
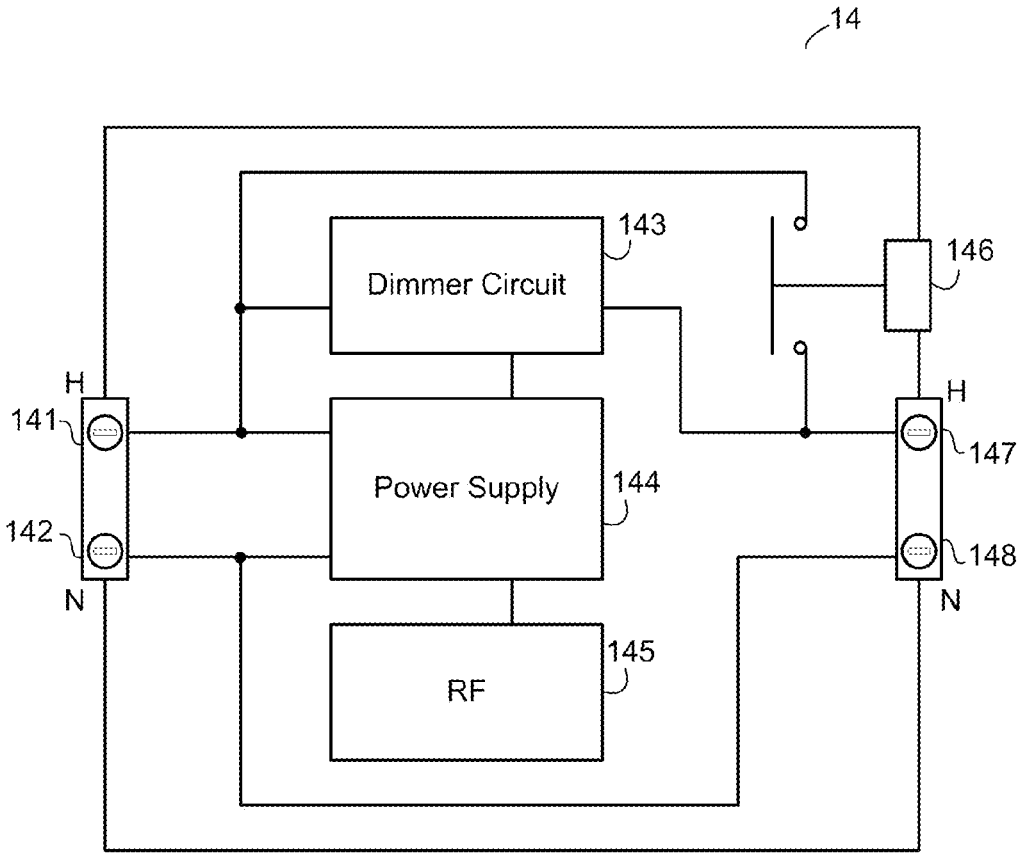

FIG. 2 is a block diagram of a dual-mode electric receptacle for use in the lighting control system of FIG. 1, according to an illustrative embodiment of the invention.

Figure 3:
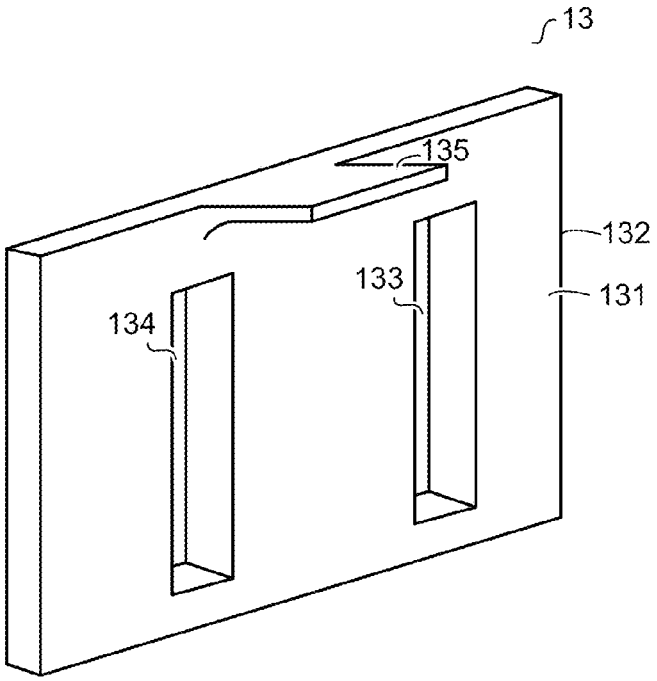

FIG. 3 shows a plug adapter for use in the lighting control system of FIG. 1, according to an illustrative embodiment of the invention.

Figure 4:
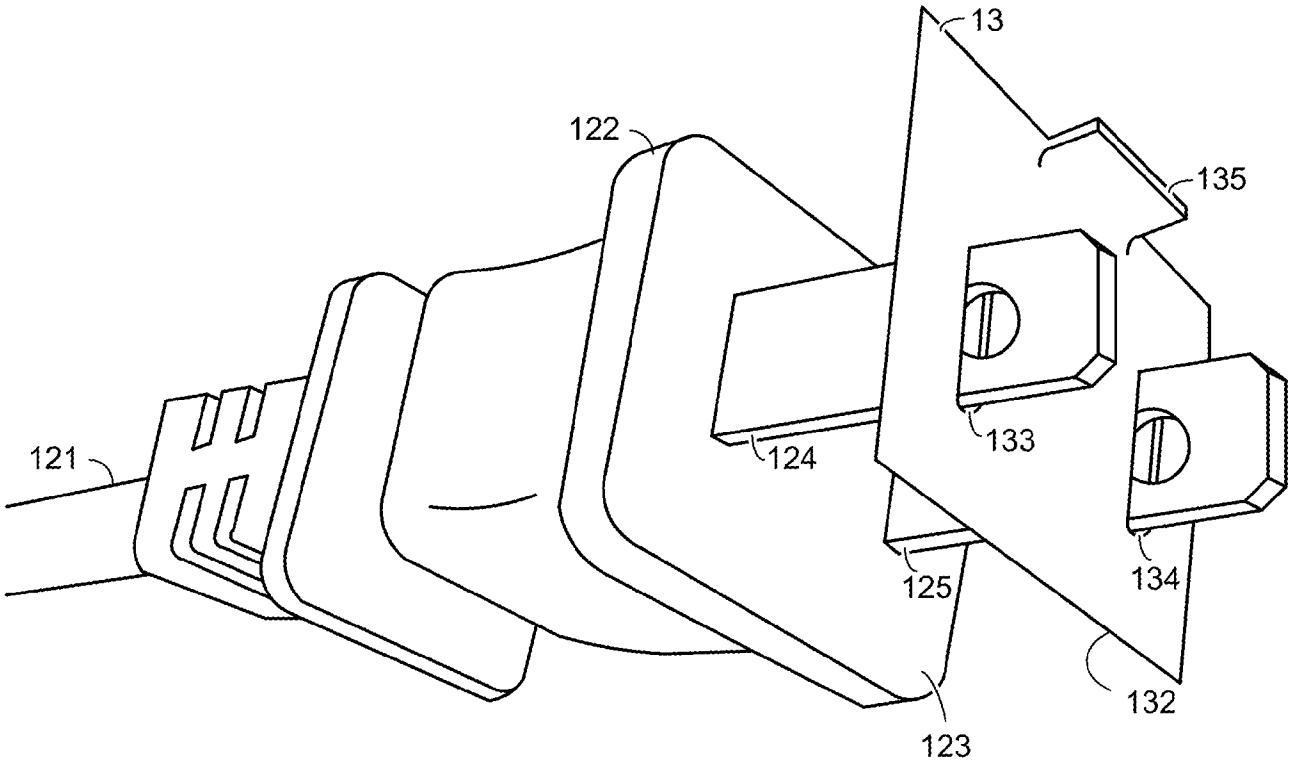

FIG. 4 shows the plug adapter of FIG. 2 partially installed on a plug, according to an illustrative embodiment of the invention.

Figure 5:
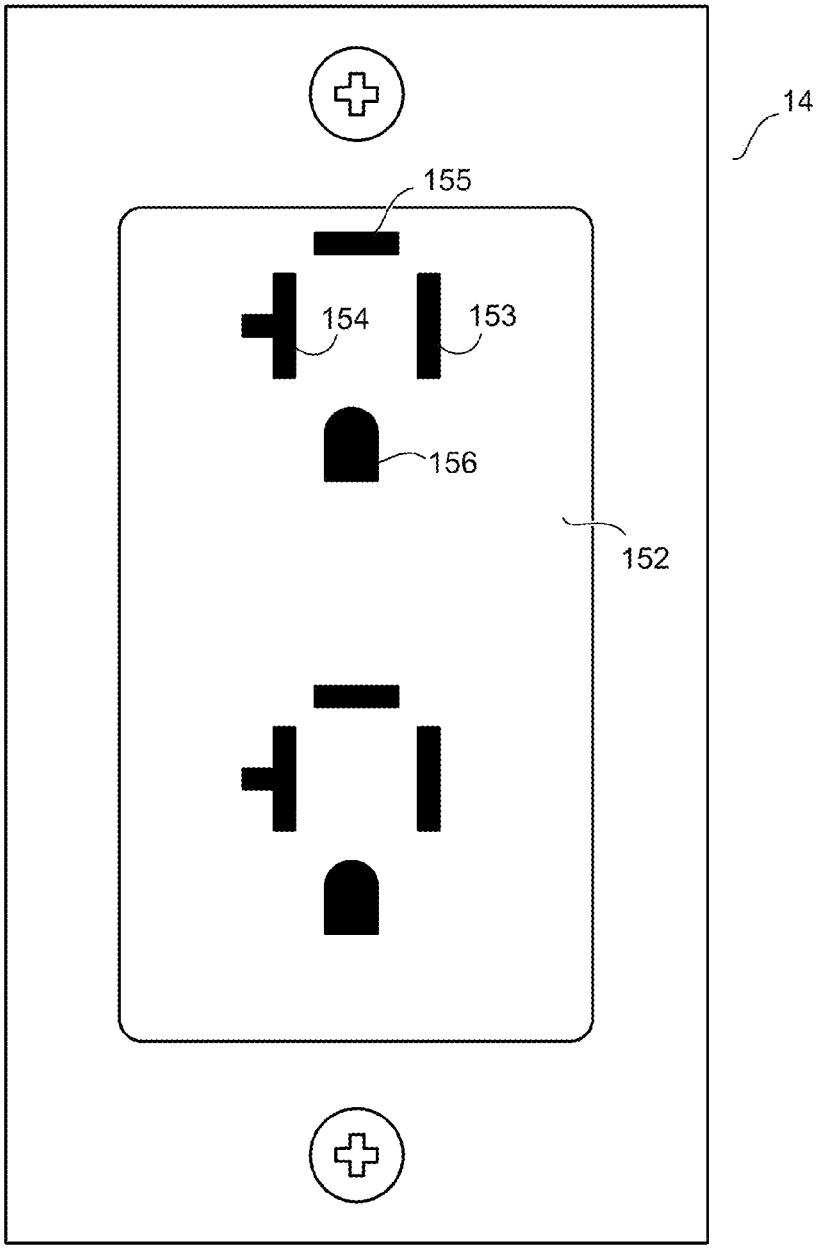

FIG. 5 shows a dual-mode electric receptacle for use in the lighting control system of FIG. 1 according to an illustrative embodiment of the invention.

Figure 6:
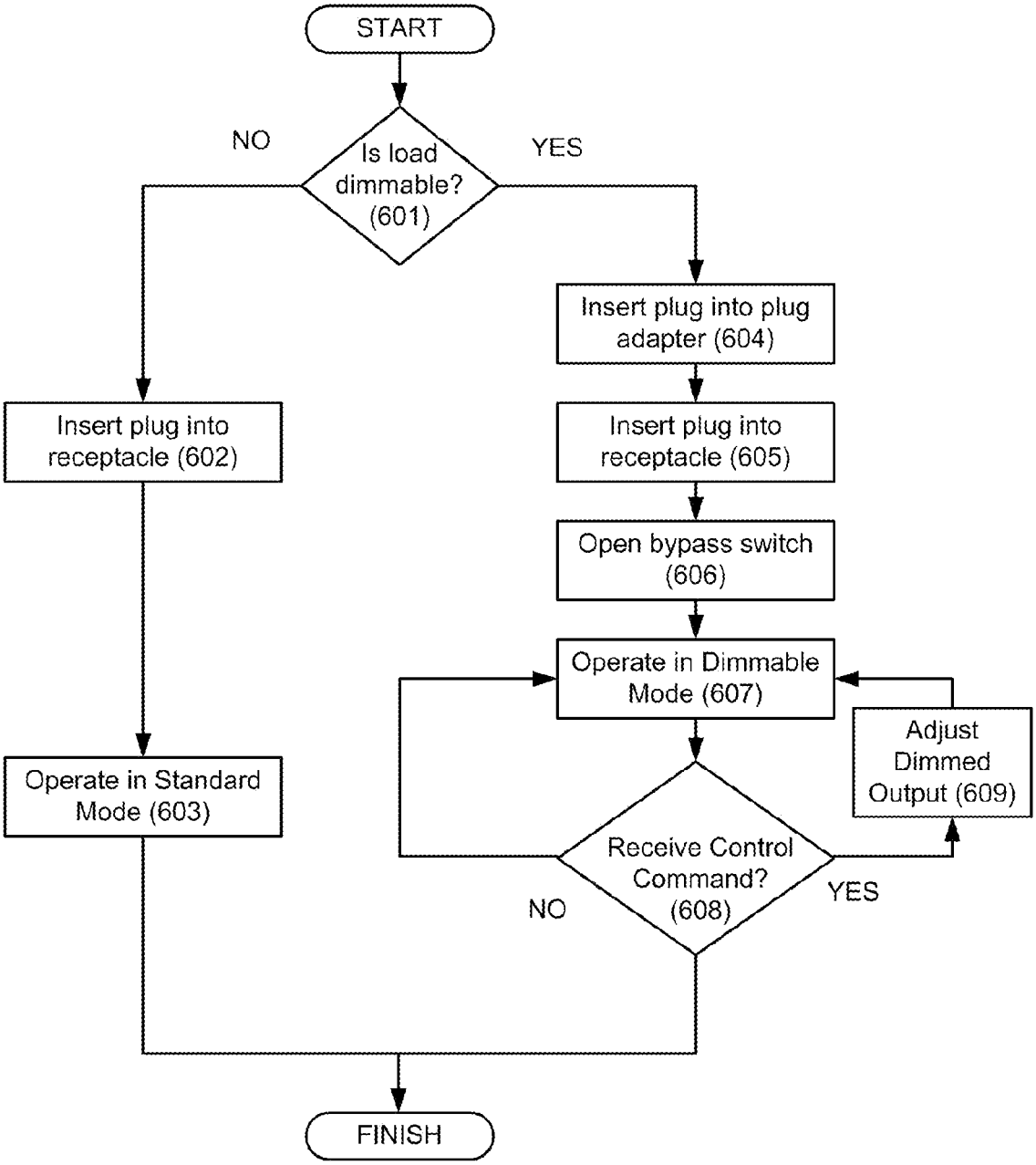

FIG. 6 is a flowchart illustrating a method for dimming a light, according to an illustrative embodiment of the invention.

Figure 7:
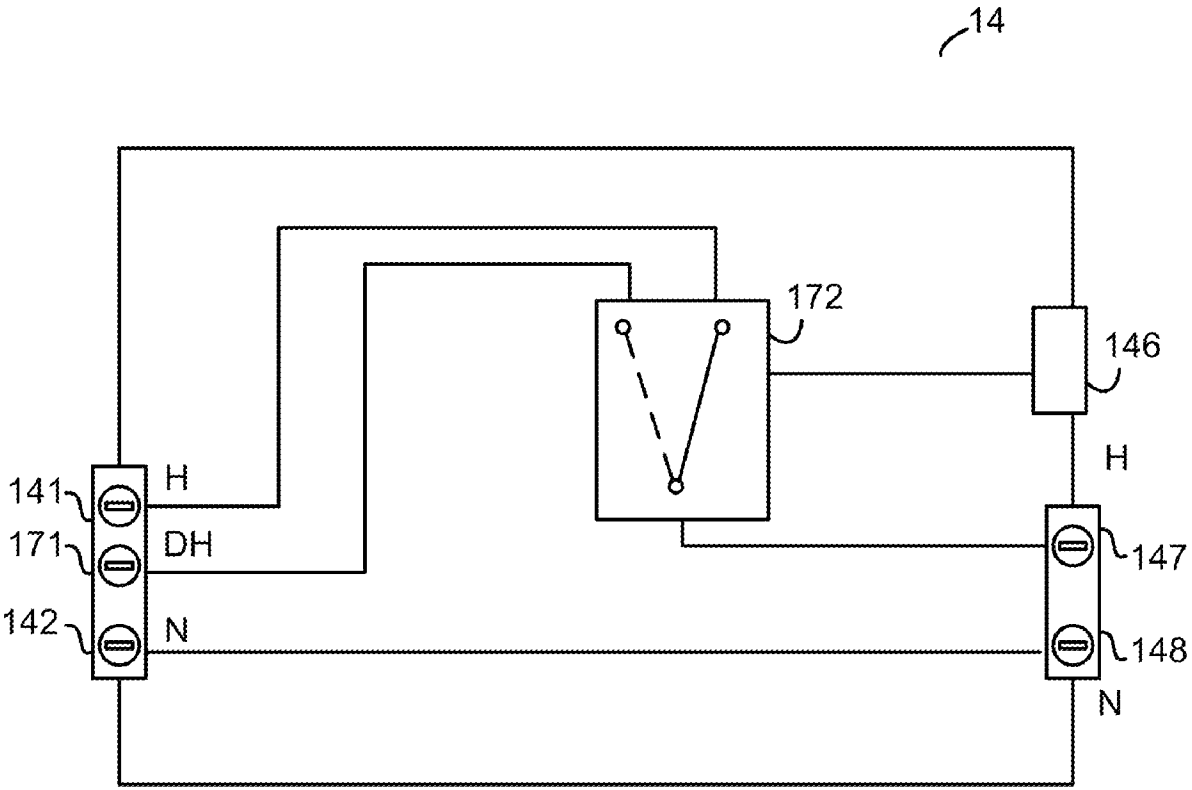

FIG. 7 is a block diagram of a dual-mode electric receptacle for use in the lighting control system of FIG. 1, according to an illustrative embodiment of the invention

LIST OF REFERENCE NUMBERS FOR THE MAJOR ELEMENTS IN THE DRAWING

The following is a list of the major elements in the drawings in numerical order.

10 lighting control system
11 overhead lamp
12 floor lamp
13 plug adapter
14 dual-mode electric receptacle
15 keypad
121 cord
122 plug
123 front face (p/o plug 122)
124 first blade (p/o plug 122)
125 second blade (p/o plug 122)
131 front surface (p/o adapter 13)
132 back surface (p/o adapter 13)
133 first adapter opening (p/o adapter 13)
134 second adapter opening (p/o adapter 13)
135 actuating portion (p/o adapter 13)
141 hot input terminal (p/o receptacle 14)
142 neutral input terminal (p/o receptacle 14)
143 dimmer circuit (p/o receptacle 14)
144 power source (p/o receptacle 14)
145 wireless communication interface (p/o receptacle 14)
146 bypass switch (p/o receptacle 14)
147 hot output terminal (p/o receptacle 14)
148 neutral output terminal (p/o receptacle 14)
151 face plate
152 face (p/o receptacle 14)
153 first receptacle opening (p/o receptacle 14)
154 second receptacle opening (p/o receptacle 14)
155 bypass opening (p/o receptacle 14)
156 ground opening (p/o receptacle 14)
171 dimmed hot input terminal (p/o receptacle 14)
172 single throw double pole switch (p/o bypass switch 146)
601 (condition of) being a dimmable load
602 (step of) receiving plug w/o plug adapter into receptacle
603 (step of) receptacle operating in standard mode
604 (step of) receiving plug into adapter
605 (step of) receiving plug and adapter into receptacle
606 (step of) switching the bypass switch open
607 (step of) receptacle operating in dimmable mode
608 (step of) receiving control signal
609 (step of) adjusting electric power according to control signal

DETAILED DESCRIPTION OF THE INVENTION

The present invention provides a system for providing dimmable power to an electric load through an electric receptacle. More particularly, the present invention provides a dual mode electric receptacle that is capable of functioning in both a standard mode and a dimmable mode. A plug adapter determines in which mode the dual-mode electric receptacle functions. The system is aesthetically pleasing, installs in straightforward manner, and meets industry standards such as the National Electrical Code (NEC) and National Electrical Manufacturers Association (NEMA) standards.

Throughout the specification, the system is described in the context of powering a floor lamp as part of a lighting control system. However, the present invention should not be limited to this context. The electric receptacle may be operated in a dimmable mode to power any electrical device which may be safely powered by a dimmable power supply.

FIG. 1 shows an illustrative lighting control system 10, according to an embodiment of the invention. The lighting control system 10 comprises an overhead lamp 11, a floor lamp 12, a plug adaptor 13, a dual-mode electric receptacle 14, and a keypad 15. The keypad 15 may be a Cameo® keypad available from Crestron Electronics, Inc. of Rockleigh, N.J. The keypad 15 is connected to an appropriate lighting feed from an AC power supply. The keypad 15 comprises an on-off switch, a triac dimmer, and a control unit by which a user can adjust the duty cycle of the dimmer and can thus dim a lighting load. The dimmed output from the dimmer switch is provided to the overhead lamp 11.

The floor lamp 12 is plugged into the dual-mode electric receptacle 14 and receives electric power from the dual-mode electric receptacle 14, not the dimmed output from the keypad 15. The floor lamp 12 further comprises a cord 121 and a plug 122. The plug adapter 13 is coupled to the plug 122 and the plug 122 with the coupled plug adapter 13 is inserted into the dual-mode electric receptacle 14 to establish electrical connection. The dual-mode electric receptacle 14 further comprises a dimmer circuit 143 (FIG. 2) and is configured for controlling the electrical power delivered to the floor lamp 12, thereby controlling the lighting level of the floor lamp 12.

The dimmer circuit 143 controls the electrical power delivered to the floor lamp 12 according to control signals received at the dual-mode electric receptacle 14. The dual-mode electric receptacle 14 may receive control signals either wired or wirelessly. For example, a user may control the lighting level of the floor lamp 12 by actuating one or more buttons of the keypad 15. The keypad 15 may be electrically connected to the dual-mode electric receptacle 14 or may communicate wirelessly with the dual-mode electric receptacle 14. Additionally, the control signal may be received at the keypad 15 or dual-mode electric receptacle 14 from a component of the lighting control system 10, such as another keypad 15, a remote control, a mobile phone, a sensor or a control processor.

In an embodiment of the invention, the floor lamp 12 may be controlled as a member of a zone of lights or electrical components. For example, a button actuation on the keypad 15 may correspond to a control signal for both the overhead lamp 11 and the floor lamp 12.

FIG. 2 is a block diagram of the dual-mode electric receptacle 14, according to an illustrative embodiment of the invention. The dual-mode electric receptacle 14 comprises a hot input terminal 141, a neutral input terminal 142, a dimmer circuit 143, a power source 144, a wireless communication interface 145, a bypass switch 146, a hot output terminal 147, and a neutral output terminal 148.

The input side of the dual-mode electric receptacle 14 is connected to alternating current (AC) power supply. For example, the AC power supply may be a 120 Volt (V) 60 Hertz (Hz) AC mains residential power supply. A hot input terminal 141 connects to an AC source hot conductor and a neutral input terminal 142 connects to an AC source neutral conductor. The output side of the electric receptacle 14 is connected to a load, such as a floor lamp 12, via a plug 122 and cord 121. The hot output terminal 147 receives a blade of a plug 122 connected to the hot conductor of the cord 121 and the neutral output terminal 148 receives a neutral blade of the plug 122 connected to the neutral conductor of the cord 121.

The dual-mode electric receptacle 14 offers two conductive paths from the hot input terminal 141 to the hot output terminal 147. A first conductive path comprises the bypass switch 146. When the bypass switch 146 is closed, the first conductive path provides a path from the hot input terminal 141 to the hot output terminal 147 which bypasses the dimmer circuit 143. Accordingly, when the bypass switch 146 is closed, the first conductive path is active and the dual-mode electric receptacle 14 operates in a standard (i.e. non-dimmable) mode.

The second conductive path from the hot input terminal 141 to the hot output terminal 147 comprises the dimmer circuit 143. When the bypass switch 146 is open, the second conductive path is active and the dual-mode electric receptacle 14 operates in a dimmable mode.

The bypass switch 146 is configured for being controlled by the plug adapter 13. For example, in an embodiment of the invention, the bypass switch 146 communicates mechanically with the plug adapter 13. The plug adapter 13 mechanically opens the bypass switch 146. In another embodiment of the invention, the bypass switch 146 may communicate with the plug adapter 13 via a non-mechanical means, such as magnetically or electrically.

When the second conductive path is active, the dimmer circuit 143 controls the amount of electrical power supplied to the floor lamp 12 via the dual-mode electric receptacle 14. In an embodiment of the invention, the dimmer circuit 143 comprises a phase controlled dimmer such as a triac, an on/off switch and a control circuit by which a user can adjust the duty cycle of the dimmer and thus control the lighting level of the floor lamp 12.

The dimmer circuit 143 controls the amount of electrical power according to control signals received by the dual-mode electric receptacle 14. In an embodiment of the invention, the dual-mode electric receptacle 14 receives control signals via the wireless communication interface 145. For example, the wireless communication interface 145 may be an RF receiver configured for receiving control signals via a wireless RF signal. In a further embodiment of the invention, the wireless communication interface 145 is configured for communicating bi-directionally. In this embodiment, the wireless communication interface 145 may comprise an RF transceiver.

The power source 144 is configured for generating a direct current (DC) voltage for powering the dimmer circuit 143, the wireless communication interface 145 and other low-voltage circuitry of the dual mode electric receptacle 14.

It is contemplated that the dual-mode electric receptacle 14 may contain other circuitry, such as display elements, network drivers, and other logic and sensors.

FIG. 3 shows a plug adapter 13 for use in the lighting control system of FIG. 1, according to an illustrative embodiment of the invention. The plug adapter 13 is preferably composed of electrically non-conductive material and configured for being inserted between a base of a plug 122 (FIG. 4) of a dimmable load and the dual-mode electric receptacle 14. A front surface 131 of the plug adapter 13 is configured for communicating with a face of the dual-mode electric receptacle 14. A back surface 132 of the plug adapter 13 is configured for communicating with a front surface 123 of the base of the plug 122 for a floor lamp 12. The plug adapter 13 comprises a first adapter opening 133 and a second adapter opening 134 defined by the front surface 131 of the plug adapter 13 and aligned with and dimensioned to receive a hot plug terminal of a plug 122, such as a first blade 124, and a neutral plug terminal of a plug 122, such as a second blade 125, respectively.

The plug adapter 13 further comprises an actuating portion 135 projecting from the front surface 131 of the plug adapter 13. The actuating portion 135 may be integrally formed with the plug adapter 13 in a molded plastic process. Alternatively, the actuating portion 135 may be a distinct element coupled to the plug adapter 13.

The actuating portion 135 is dimensioned to extend beyond the front surface 131 of the plug adapter 13 so that the actuating portion 135 may be inserted into the dual-mode electric receptacle 14 when the front surface 131 of the plug adapter 13 is flush with the face 123 of the dual-mode electric receptacle 14. The actuating portion 135 is dimensioned and aligned for insertion into a corresponding opening in the face 123 of the dual-mode electric receptacle 14. In the embodiment shown in FIG. 3, the actuating portion 135 is of a generally rectangular shape and is disposed substantially toward a top edge of the plug adapter 13. Advantageously, disposing the actuating portion 135 substantially near the top edge of the adapter provides an unobstructed vantage point for a user to insert the adapter into the dual-mode electric receptacle 14.

The actuating portion 135 should not be limited to rectangular shapes. In other embodiments, the actuating portion 135 may have a different shape corresponding to a non-rectangular opening in the dual-mode electric receptacle 14. Additionally, the actuating portion 135 should not be limited to placement toward the top of the plug adapter 13. In other embodiments, the actuating portion 135 may be disposed toward the bottom, right or left of the front surface 131 of the plug adapter 13 corresponding to an opening in the face of the dual-mode electric receptacle 14.

The actuating portion 135 communicates with the bypass switch 146 of the dual-mode electric receptacle 14 and is configured for switching the bypass switch 146 to the open state. The presence or absence of the plug adapter 13 thereby determines the active conductive path and accordingly, the mode of the dual-mode electric receptacle 14. By inserting the plug adapter 13 into the face of the dual-mode electric receptacle 14, the second conductive path is switched active and the dual-mode electric receptacle 14 operates in the dimmable mode.

In this embodiment, the actuating portion 135 mechanically communicates with the bypass switch 146 to open the bypass switch 146. For example, the bypass switch 146 may comprises a single pole electromechanical switch and wherein the actuating portion 135 physically disconnects the two contacts. However, the bypass switch 146 should not be limited to a single pole switch or an electromechanical switch and the actuating portion 135 should not be limited to a physical structure of the plug adapter 13.

FIG. 4 shows the plug adapter 13 of FIG. 3 partially installed on a plug 122, according to an illustrative embodiment of the invention. When fully installed, the front surface 123 of the body of the plug 122 is flush with the back surface 132 of the plug adapter 13. The plug adapter 13 is dimensioned to be inserted onto a plug 122 of a floor lamp 12.

The plug 122 comprises two metal blades 124, 125 projecting from a front surface 123 of a plug body 122. A flexible electric cord 121 extends from a rear part of the body. The electric cord 121 comprises two insulated conductors, each of which is connected within the body to a respective one of the blades. The blades of the plug 122 form the hot and neutral terminals for the plug 122. Although the embodiment shown in FIG. 3 includes hot and neutral plug terminals that are flat blades, the invention could also be applied to plugs having hot and neutral conductors in other shapes. These could include, for example, D- or U-shaped conductors of U.S. ANSI/NEMA standard WD 6-2002 sheet 5-15 ("NEMA 5-15"), or square, circular, L- or T-shaped conductors.

The configuration of the hot and neutral blades of the plug 122 comply with U.S. ANSI/NEMA standard WD 6-2002 sheet 1-15 ("NEMA 1-15") for 110 V, 15 A, 2 wire plugs. That is to say, the neutral blade has a length that is between 0.625 and 0.718 inches, a height that is between 0.307 and 0.322 inches, and a width that is approximately 0.06 inches. The hot blade has a length that is between 0.625 and 0.718 inches, a height that is between 0.24 and 0.26 inches, and a width that is approximately 0.06 inches.

The first adapter opening 133 and the second adapter opening 134 of the plug adapter 13 are aligned with and dimensioned to receive plug blades 124, 125 compliant with industry standards, such as the National Electrical Code (NEC) and standards of the National Electrical Manufacturers Association (NEMA). That is to say the plug adapter 13 is dimensioned for receiving a hot blade 124 and a neutral blade 125 of the dimensions described above. Advantageously, this allows the plug adapter 13 to receive dimmable lamps with standard plug dimensions and does not require modification of the dimmable lamp plug dimensions to fit into the plug adapter 13 or dual-mode electric receptacle 14.

FIG. 5 shows a dual-mode electric receptacle for use in the lighting control system of FIG. 1 according to an illustrative embodiment of the invention. The dual-mode electric receptacle 14 is configured for flush mounting in a standard electrical wall box. In the embodiment of the dual-mode electric receptacle 14 shown in FIG. 5, the dual-mode electric receptacle 14 is a double receptacle unit. Each of the electric receptacles provides openings 156 for a ground pin. In the embodiment shown in FIG. 5, a face plate 151 is mounted over the dual-mode electric receptacle 14 for aesthetic reasons.

The dual-mode electric receptacle 14 comprises a face 152 with a first receptacle opening 153, a second receptacle opening 154, and a bypass opening 155 disposed on the face 152 of the dual-mode electric receptacle 14. The face 152 of the dual-mode electric receptacle 14 is configured for communicating with the front surface 131 of the plug adapter 13. The bypass opening 155 is aligned with and dimensioned for receiving the actuating portion 135 of the plug adapter 13, thereby providing the actuating portion 135 access to the bypass switch 146. The first receptacle opening 153 and the second receptacle opening 154 are aligned with and dimensioned for receiving the first blade 124 of the plug 122 and the second blade 125 of the plug 122, respectively.

The dual-mode electric receptacle 14 is dimensioned as a standard receptacle in accordance with "NEMA 5-15". Therefore, the first adapter opening 133 and second adapter opening 134 of the dual-mode electric receptacle 14 are dimensioned to receive plug blades compliant with industry standards and of the dimensions as described above. This allows for devices with standard plug sizes to be operated from the dual-mode electric receptacle 14.

FIG. 6 is a flowchart illustrating a method for providing a dimmed output to an electric load, according to an illustrative embodiment of the invention. At condition 601, a determination is made as to whether the load is a dimmable load. A floor lamp 12 is one example of a dimmable load.

In step 602, if the load is not a dimmable load, such as certain vacuum cleaners, a plug 122 of the load is inserted directly into a dual-mode electric receptacle 14.

In step 603, the dual-mode electric receptacle 14 with the inserted plug 122 for the non-dimmable load operates in a standard (i.e. non-dimmable) mode.

In step 604, if the load is a dimmable load, the plug 122 of the load is inserted into a plug adapter 13 comprising a first blade opening 133 dimensioned to receive a first blade 124 of a plug 122 and a second blade opening 134 dimensioned to receive a second blade 125 of a plug 122. A back surface 132 of the plug adapter 13 mates flush with a front surface 123 of the plug body when the plug 122 is fully inserted onto the plug adapter 13. The plug adapter 13 further comprises an actuating portion 135 extending from the front surface 131 of the plug adapter 13.

In step 605, the plug 122 with the coupled plug adapter 13 are inserted into a face 152 of the dual-mode electric receptacle 14. The dual-mode electric receptacle 14 comprises a first receptacle opening 153, a second receptacle opening 154, and a plug adapter 13 opening 155 aligned with and dimensioned to receive the first blade 124, second blade 125, and actuating portion 135, respectively.

In step 606, a bypass switch 146 of the dual-mode electric receptacle 14 is switched to an open state by the actuating portion 135 of the plug adapter 13. The dual-mode electric receptacle 14 is thereby placed in the in the dimmable mode. The bypass switch 146 may be switched to the open state concurrently with the actuating portion 135 being inserted into the dual-mode electric receptacle 14. By switching the bypass switch 146 open, the active conductive path between an input side of the dual-mode electric receptacle 14 and an output side of the dual-mode electric receptacle 14 comprises a dimmer circuit 143.

In a further embodiment of the invention, the step of switching a bypass switch 146 of the dual-mode electric receptacle 14 to an open state with the actuating portion 135 of the plug adapter 13 further comprises the step of mechanically switching the bypass switch 146 of the dual-mode electric receptacle 14 to an open state with the actuating portion 135 of the plug adapter 13.

In step 607, the dual-mode electric receptacle 14 operates in a dimmable mode. Specifically, the dimmer circuit 143 of the dual-mode electric receptacle 14 controls the amount of output power supplied to the floor lamp via the dual-mode electric receptacle 14.

In a further embodiment of the invention, the method for operating a dual-mode electric receptacle 14 in a dimmable mode further comprising the steps of receiving a control signal corresponding to a dim level of the dimmable load (step 608) and adjusting the amount of electric power delivered to the load by the dual-mode electric receptacle 14 according to the control signal (step 609).

FIG. 7 is a block diagram of the dual-mode electric receptacle, according to an illustrative embodiment of the invention. In an embodiment of the invention, the dual-mode electric receptacle 14 may receive a electric power from an AC mains power supply and dimmed electric power from an external lighting control unit. For example, the electric receptacle 14 may be electrically coupled to a lighting keypad 15 comprising a dimmer circuit. The dimmer circuit is configured for supplying dimmed electric power according to control inputs received at the keypad 15, such as via button actuations or control signals received via a wired connection or wireless connection.

The dual-mode electric receptacle 14 comprises a hot input terminal 141, a dimmed hot input terminal 171, a neutral input terminal 142, a bypass switch 146, a hot output terminal 147, and a neutral output terminal 148.

The hot input terminal 141 of the dual-mode electric receptacle 14 is connected to alternating current (AC) power supply. For example, the AC power supply may be a 120 Volt (V) 60 Hertz (Hz) AC mains residential power supply. The hot input terminal 141 connects to an AC source hot conductor and a neutral input terminal 142 connects to an AC source neutral conductor.

The dimmed hot input terminal 171 is connected to an external lighting control unit comprising a dimmer circuit, such as dimmer circuit 143 in FIG. 2. For example, the lighting control unit may be a lighting keypad 15 comprising a dimmer circuit. The dimmer circuit controls the amount of electrical power supplied to the floor lamp via the dual-mode electric receptacle 14. In an embodiment of the invention, the dimmer circuit 143 comprises a phase controlled dimmer such as a triac, an on/off switch and a control circuit by which a user can adjust the duty cycle of the dimmer and thus control the lighting level of the floor lamp 12.

The dimmer circuit 143 controls the amount of electrical power according to control signals received by the lighting keypad 15. For example, the lighting keypad 15 may receive control signals via a wireless communication interface, such as an RF receiver. Additionally, the lighting keypad 15 may receive control signals via a wired interface or via button actuations at the keypad 15.

The output side of the electric receptacle 14 is connected to a load, such as a floor lamp 12, via a plug 122 and cord 121. The hot output terminal 147 receives a blade of a plug 122 connected to the hot conductor of the cord 121 and the neutral output terminal 148 receives a neutral blade of the plug 122 connected to the neutral conductor of the cord 121.

The dual-mode electric receptacle 14 offer two conductive paths from the hot input terminal 141 to the hot output terminal 147. The first conductive path connects the hot input terminal 141 to the hot output terminal 147 and is configured for delivering non-dimmed electrical power to the load via the electric receptacle. A second conductive path connects the dimmed hot input terminal 171 to the hot output terminal 147 and is configured for delivering dimmed electrical power to the load via the electric receptacle 14.

The first conductive path is configured for being active when the bypass switch 146 is in a first position. The second conductive path is configured for being active when the bypass switch 146 is in a second position. For example, in an embodiment of the invention, the bypass switch 146 may comprise a single pole double throw (SPDT) switch 172. A first terminal of the SPDT switch 172 is electrically coupled to the hot input terminal 141 and a second terminal of the SPDT switch 172 is electrically coupled to the dimmed hot input terminal 171. A common terminal of the SPDT switch 172 is connected to the hot output terminal 147. The SPDT switch 172 may be mechanically actuated via the actuating portion 135 of the plug adapter 13. Accordingly, when the actuating portion 135 is inserted in the electric receptacle 14, the bypass switch 146 is in a second position and the SPDT switch 172 is electrically connecting the dimmed hot input terminal 171 to the hot output terminal 147, thereby activating the second conductive path. Alternatively, when the actuating portion 135 is not inserted in the electric receptacle 14, the bypass switch 146 is in a first portion and the SPDT switch 172 is electrically connecting the hot input terminal 141 to the hot output terminal 147, thereby activating the first conductive path.

The bypass switch 146 is configured for being controlled by the plug adapter 13. For example, in an embodiment of the invention, the bypass switch 146 communicates mechanically with the plug adapter 13. The plug adapter 13 mechanically positions the bypass switch 146 (i.e. sets the SPDT switch 172 in a second position). In another embodiment of the invention, the bypass switch 146 may communicate with the plug adapter 13 via a non-mechanical means, such as magnetically or electrically.

INDUSTRIAL APPLICABILITY

To solve the aforementioned problems, the present invention is a unique system in which a plug adapter is inserted between a plug 122 and a dual-mode electric receptacle, thereby switching the dual-mode electric receptacle from standard operation to dimmable operation.

LIST OF ACRONYMS USED IN THE DETAILED DESCRIPTION OF THE INVENTION

The following is a list of the acronyms used in the specification in alphabetical order.

A amps
AC alternating current
ANSI American National Standards Institute
DC direct current
Hz Hertz
kW kilowatts
NEC National Electrical Code
NEMA National Electrical Manufacturing Association
SPDT single pole double throw
RF radio frequency
V Volt

ALTERNATE EMBODIMENTS

Alternate embodiments may be devised without departing from the spirit or the scope of the invention. In an embodiment of the invention, the actuating portion 135 may be a magnet configured for magnetically communicating with the bypass switch or a light source configured for photoelectrically communicating with the bypass switch.

What is claimed is:

1. An electric receptacle configured for operating in a dimmable mode when a plug coupled to a plug adapter is inserted into the electric receptacle and operating in a standard mode when a plug not coupled to the plug adapter is inserted into the electric receptacle, the electric receptacle comprising:

(a) a first conductive path from a hot input terminal of the electric receptacle to a hot output terminal of the electric receptacle comprising a bypass switch, the first conductive path being operable when the bypass switch is in a closed state; and (b) a second conductive path from the hot input terminal of the electric receptacle to the hot output terminal of the electric receptacle comprising a dimmer circuit configured for controlling the amount of electric power delivered to a dimmable load, the second conductive path being operable when the bypass switch of the first conductive path is in an open state.

2. The electric receptacle of claim 1 wherein the bypass switch is configured for being in the open state when a plug adapter is inserted into the electric receptacle.

3. The electric receptacle of claim 2 further comprising a bypass opening defined by a face of the electric receptacle and aligned with and dimensioned for receiving an actuating portion of a plug adapter.

4. The electric receptacle of claim 1 wherein the dimmer circuit further comprises a triac.

5. The electric receptacle of claim 1 further comprising a wireless communication interface for receiving a wireless control signal.

6. The electric receptacle of claim 5 wherein the wireless communication interface is a wireless RF receiver.

7. The electric receptacle of claim 5 wherein the control signal corresponds to a light level of the dimmable load.

8. The electric receptacle of claim 1 further comprising a first plug opening defined by the face of the electric receptacle and a second plug opening defined by the face of the electric receptacle, each of the plug openings aligned with and dimensioned for receiving a hot plug terminal and a neutral plug terminal.

9. The electric receptacle of claim 8 wherein the first adapter opening and second adapter opening are dimensioned to conform to industry standards.

10. An electric receptacle configured for operating in a dimmable mode when a plug coupled to a plug adapter is inserted into the electric receptacle and operating in a standard mode when a plug not coupled to the plug adapter is inserted into the electric receptacle, the electric receptacle comprising:

(a) a bypass switch;

(b) a hot input terminal configured for receiving electric power from an AC mains power supply;

(c) a dimmed hot input terminal configured for receiving electric power from dimmed power supply;

(d) a first conductive path from the hot input terminal of the electric receptacle to a hot output terminal of the electric receptacle, the first conductive path being operable when the bypass switch is in a first position; and (e) a second conductive path from the dimmed hot input terminal of the electric receptacle to the hot output terminal of the electric receptacle and operable when the bypass switch of the first conductive path is in a second position.

11. The electric receptacle of claim 10 wherein the bypass switch is configured for being in the second position when a plug adapter is inserted into the electric receptacle.

12. The electric receptacle of claim 11 further comprising a bypass opening defined by a face of the electric receptacle and aligned with and dimensioned for receiving an actuating portion of a plug adapter.

13. The electric receptacle of claim 11 wherein the bypass switch comprises a single pole double throw switch, the single pole double throw switch further comprising a first terminal electrically connected to the hot input terminal, a second terminal electrically connected to the dimmed hot input terminal and a common terminal electrically connected to the hot output terminal.

14. An electric receptacle system comprising:

(a) a plug adapter comprising an actuating portion and configured for receiving a hot plug terminal of a plug and a neutral plug terminal of the plug; and (b) an electric receptacle comprising a bypass opening defined by the face of the electric receptacle and configured for (i) operating in a dimmable mode when the actuating portion of the plug adapter is inserted into the bypass opening, and (ii) operating in a standard mode when the actuating portion of the plug adapter is not inserted into the bypass opening.

15. The electric receptacle system of claim 14 wherein the electric receptacle further comprises:

(a) a first conductive path from a hot input terminal of the electric receptacle to a hot output terminal of the electric receptacle, the first conductive path being operable when the electric receptacle is operating in the standard mode, and (b) a second conductive path from hot input terminal of the electric receptacle to the hot output terminal of the electric receptacle, the second conductive path being operable when the electric receptacle is operating in the dimmable mode.

16. The electric receptacle system of claim 15 wherein the first conductive path comprises a bypass switch configured for being in an open state when the plug adapter is inserted into the electric receptacle.

17. The electric receptacle system of claim 15 wherein the second conductive path comprises a dimmer circuit configured for controlling the amount of electric power delivered by the electric receptacle.

18. The electric receptacle system of claim 14 wherein the first blade opening and second blade opening of the plug adapter and the first blade opening and second blade opening of the electric receptacle are dimensioned to conform to industry standards.

19. The electric receptacle system of claim 14 wherein the actuating portion of the plug adapter extends from the front surface of the plug adapter and is aligned with and dimensioned for being inserted into the bypass opening of the electric receptacle.

20. The electric receptacle system of claim 19 wherein the actuating portion is configured for communicating mechanically with the bypass switch of the electric receptacle.

21. The electric receptacle system of claim 14 wherein the electric receptacle further comprises:

(a) a bypass switch;

(b) a hot input terminal configured for receiving electric power from an AC mains power supply;

(c) a dimmed hot input terminal configured for receiving electric power from dimmed power supply;

(d) a first conductive path from the hot input terminal of the electric receptacle to a hot output terminal of the electric receptacle, the first conductive path being operable when the bypass switch is in a first position; and (e) a second conductive path from the dimmed hot input terminal of the electric receptacle to the hot output terminal of the electric receptacle and operable when the bypass switch of the first conductive path is in a second state.

22. The electric receptacle of claim 21 wherein the bypass switch is configured for being in a second position when a plug adapter is inserted into the electric receptacle.

23. The electric receptacle of claim 22 wherein the bypass switch comprises a single pole double throw switch, the single pole double throw switch further comprising a first terminal electrically connected to the hot input terminal, a second terminal electrically connected to the dimmed hot input terminal and a common terminal electrically connected to the hot output terminal.

24. An electric receptacle system comprising:

(a) a plug adapter configured for receiving a hot plug terminal of a plug and a neutral plug terminal of the plug and comprising (i) a back surface dimensioned for being flush with the plug when the plug is inserted into the plug adapter;

(ii) an actuating portion, the actuating portion extending from a front surface of the plug adapter substantially near a top edge of the plug adapter, (ii) a first adapter opening defined by the front surface of the plug adapter, the first adapter opening aligned with and dimensioned for receiving a hot plug terminal of a plug, and (iii) a second adapter opening defined by the front surface of the plug adapter, the second adapter opening aligned with and dimensioned for receiving a neutral plug terminal of a plug; and (b) an electric receptacle comprising (i) a bypass opening defined by a face of the electric receptacle, the bypass opening aligned with and dimensioned for receiving the actuating portion of the plug adapter, (ii) a first receptacle opening defined by the face of the electric receptacle, the first receptacle opening aligned with and dimensioned for receiving the hot plug terminal of the plug, (iii) a second receptacle opening defined by the face of the electric receptacle, the second receptacle opening aligned with and dimensioned for receiving the neutral plug terminal of the plug, (iv) a hot input terminal, (v) a hot output terminal, (vi) a first conductive path from the hot input terminal to the hot output terminal, the first conductive path comprising a bypass switch and being operable when the actuating portion is inserted into the bypass opening, and (vii) a second conductive path from the hot input terminal to the hot output terminal comprising a dimmer circuit configured for controlling the amount of electric power delivered by the electric receptacle, the second conductive path being operable when the actuating portion is not inserted into the bypass opening.

25. A method for operating a dual-mode electric receptacle, the method comprising:

(a) receiving a hot plug terminal of a plug and a neutral plug terminal of the plug into a plug adapter, the plug adapter comprising an actuating portion and a first adapter opening defined by a front surface of the plug adapter and aligned with and dimensioned for receiving the hot plug terminal and a second adapter opening defined by the front surface of the plug adapter and aligned with and dimensioned for receiving the neutral plug terminal;

(b) receiving the actuating portion, hot plug terminal and neutral plug terminal into the dual-mode electric receptacle, the electric receptacle comprising (i) a first receptacle opening defined by a face of the electric receptacle and aligned with and dimensioned for receiving the hot plug terminal, (ii) a second receptacle opening defined by the face of the electric receptacle and aligned with and dimensioned for receiving the neutral plug terminal, and (iii) a bypass opening defined by the face of the electric receptacle and aligned with and dimensioned for receiving the actuating portion of the plug adapter;

(c) switching a bypass switch of the electric receptacle with the actuating portion of the plug adapter thereby placing the dual-mode electric receptacle in a dimmable mode; and (d) operating the electric receptacle in the dimmable mode.

26. The method of claim 25 wherein the step of switching the bypass switch of the electric receptacle with the actuating portion of the plug adapter further comprises the step of mechanically switching the bypass switch of the electric receptacle to an open state with the actuating portion of the plug adapter.

27. The method of claim 25 further comprising the steps of:

(a) receiving a control signal corresponding to a light level of the dimmable load; and (b) adjusting the amount of electric power delivered to the load according to the control signal.

28. The method of claim 25, wherein the step of switching the bypass switch of the electric receptacle comprises at least one selected from (i) switching the bypass switch from a closed state to an open state, and (ii) switching the bypass switch from a first position to a second position.

* * * * *